US011535475B2

(12) United States Patent
Ricco'

(10) Patent No.: US 11,535,475 B2
(45) Date of Patent: Dec. 27, 2022

(54) WEB ALIGNMENT DEVICE, A PACKAGING MACHINE HAVING A WEB ALIGNMENT DEVICE AND A SPLICING METHOD

(71) Applicant: TETRA LAVAL HOLDINGS & FINANCE S.A., Pully (CH)

(72) Inventor: Marco Ricco', Spilamberto (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 194 days.

(21) Appl. No.: 16/761,994

(22) PCT Filed: Nov. 28, 2018

(86) PCT No.: PCT/EP2018/082853
§ 371 (c)(1),
(2) Date: May 6, 2020

(87) PCT Pub. No.: WO2019/110389
PCT Pub. Date: Jun. 13, 2019

(65) Prior Publication Data

US 2020/0307937 A1 Oct. 1, 2020

(30) Foreign Application Priority Data

Dec. 4, 2017 (EP) ..... 17205077

(51) Int. Cl.
*B65H 23/02* (2006.01)
*B65B 9/20* (2012.01)
(Continued)

(52) U.S. Cl.
CPC ..... *B65H 23/0204* (2013.01); *B65B 9/2035* (2013.01); *B65B 41/12* (2013.01);
(Continued)

(58) Field of Classification Search
CPC ..... B65B 57/02; B65B 41/12; B65B 41/18; B65B 9/2035; B65H 19/1852;
(Continued)

(56) References Cited

U.S. PATENT DOCUMENTS 4,003,511 A * 1/1977 Schwestka ..... B65H 23/032 228/49.1
4,291,825 A * 9/1981 Glanz ..... B65H 23/0216 226/18

(Continued)

FOREIGN PATENT DOCUMENTS

| | | | |
|---|---|---|---|
| EP | 0283086 | A2 | 9/1988 |
| EP | 2258643 | A1 | 12/2010 |
| WO | 2005110903 | A1 | 11/2005 |

OTHER PUBLICATIONS

International Search Report (PCT/ISA/210) and Written Opinion (PCT/ISA/237) dated Jan. 31, 2019, by the European Patent Office as the International Searching Authority for International Application No. PCT/EP2018/082853.

*Primary Examiner* — Andrew M Tecco
(74) *Attorney, Agent, or Firm* — Buchanan Ingersoll & Rooney PC

(57) ABSTRACT

There is described a web alignment device for aligning a web comprising an engagement surface for supporting the web, a clamp assembly for clamping the web on at least a clamp portion of the engagement surface, an alignment control assembly for controlling a correct alignment of the web. The alignment control assembly comprises a control unit for generating a trigger signal if the web is correctly aligned, a first sensor device for detecting and/or determining a desired position of a first section of the web and to send at least a first signal to the control unit if the first section is positioned in the desired position, and a second sensor device for detecting and/or determining a desired position of
(Continued)

a second section of the web and to send a second signal to the control unit if the second section is positioned in the desired position.

19 Claims, 6 Drawing Sheets

(51) Int. Cl.
*B65B 41/12* (2006.01)
*B65B 41/18* (2006.01)
*B65B 57/02* (2006.01)
*B65H 19/18* (2006.01)

(52) U.S. Cl.
CPC ..... *B65B 41/18* (2013.01); *B65B 57/02* (2013.01); *B65H 19/1852* (2013.01); *B65H 2301/46115* (2013.01); *B65H 2553/25* (2013.01); *B65H 2553/416* (2013.01); *B65H 2701/11214* (2013.01); *B65H 2701/1315* (2013.01); *B65H 2801/69* (2013.01)

(58) Field of Classification Search
CPC ..... B65H 2301/4421; B65H 2553/25; B65H 2553/416; B65H 2801/69
See application file for complete search history.

(56) References Cited

U.S. PATENT DOCUMENTS 4,655,865 A * 4/1987 Nozaka ..... B65H 19/1852 156/502
4,908,091 A * 3/1990 Traegaardh ..... B65H 19/1852 156/159
5,388,387 A * 2/1995 McElvy ..... B65B 9/207 242/421
5,679,195 A * 10/1997 O'Dwyer ..... B65H 19/1873 242/554.6
6,397,557 B1 * 6/2002 Bassissi ..... B29C 53/54 53/550
6,588,174 B2 * 7/2003 Yamamoto ..... B65B 41/18 53/64
7,827,768 B2 * 11/2010 Rosberg ..... B65B 9/20 53/551
9,073,716 B2 * 7/2015 Brighenti ..... B65H 57/26
9,637,260 B2 * 5/2017 Ghirardello ..... B65B 51/30
2005/0241774 A1 * 11/2005 Hart ..... B65H 23/032 242/551
2011/0280701 A1 * 11/2011 Brighenti ..... B66F 9/18 242/615.3
2014/0196407 A1 * 7/2014 Ghirardello ..... B65B 9/20 53/167

* cited by examiner

WEB ALIGNMENT DEVICE, A PACKAGING MACHINE HAVING A WEB ALIGNMENT DEVICE AND A SPLICING METHOD

TECHNICAL FIELD

The present invention relates to a web alignment device for aligning a web, in particular a web of packaging material, within a packaging machine, in particular a packaging machine for producing sealed packages of a pourable product, even more particular of a pourable food product.

The present invention may be used to particular advantage to align a new web, in particular a new web of packaging material, prior to splicing the new web to a web in use, in particular a web of packaging material in use.

In particular, the present invention also relates to a packaging machine having at least one web alignment device, the packaging machine being configured to form sealed packages, in particular to form sealed packages filled with a pourable product, even more particular to form sealed packages filled with a pourable food product.

The present invention also relates to a method of splicing a web in use, in particular a web of packaging material in use, to a new web, in particular a new web of packaging material.

BACKGROUND ART

As is known, many liquid or pourable food products, such as fruit juice, UHT (ultra-high-temperature treated) milk, wine, tomato sauce, etc., are sold in packages made of sterilized packaging material.

A typical example is the parallelepiped-shaped package for liquid or pourable food products known as Tetra Brik Aseptic (registered trademark), which is made by sealing and folding laminated strip packaging material. The packaging material has a multilayer structure comprising a base layer, e.g. of paper, covered on both sides with layers of heat-seal plastic material, e.g. polyethylene. In the case of aseptic packages for long-storage products, such as UHT milk, the packaging material also comprises a layer of oxygen-barrier material, e.g. an aluminum foil, which is superimposed on a layer of heat-seal plastic material, and is in turn covered with another layer of heat-seal plastic material forming the inner face of the package eventually contacting the food product.

Packages of this sort are normally produced on fully automatic packaging machines, which advance a web of packaging material from a magazine unit through a sterilization unit of the packaging machine for sterilizing the web of packaging material, e.g. by means of chemical sterilization (e.g. by applying a chemical sterilizing agent, such as a hydrogen peroxide solution) or physical sterilization (e.g. by means of an electron beam). Then, the sterilized web of packaging material is maintained and advanced within an isolation chamber (a closed and sterile environment), and is folded and sealed longitudinally to form a tube having a longitudinal seam portion, which is further fed along a vertical advancing direction.

In order to complete the forming operations, the tube is continuously filled with a sterilized or sterile-processed pourable food product, and is transversally sealed and subsequently cut along equally spaced transversal cross sections within a packaging unit of the packaging machine during advancement along the vertical advancing direction.

Pillow packages are so obtained within the packaging machine, each pillow package having a longitudinal sealing band, a top transversal sealing band and a bottom transversal sealing band.

In more detail, a typical packaging machine comprises:

a magazine unit hosting a first reel carrying in a wound-up manner a first web of packaging material and a second reel carrying in a wound-up manner a second web of packaging material;

- conveying means for advancing in a known manner at least one of the first web of packaging material and the second web of packaging material as the web in use along a web advancement path from a host station to a forming station, at which, in use, the web in use is formed into a tube;
- a sterilizing unit for sterilizing the web of packaging material;
- a tube forming device arranged within an isolation chamber and being adapted to form the tube from the advancing web of packaging material;
- a sealing device for longitudinally sealing the tube;
- a filling device for filling the tube with the pourable product; and
- a package forming unit adapted to produce the single packages from the tube by shaping, transversally sealing and transversally cutting the packages.

As the capacity of the first reel and the second reel is limited it is necessary to splice the web in use with a new web, which is either the first web of packaging material or the second web of packaging material depending on which one is the web in use.

Therefore, a typical packaging machine, in particular the magazine unit, comprises a splicing device, which is adapted to transversally seal a trailing portion of the web in use with a leading portion of the new web.

However, for the continuous operation of the packaging machine it is crucial to correctly align (orient) the new web with respect to the web in use and the web advancement path.

Thus, a typical packaging machine also comprises at least one web alignment device for aligning the new web prior to the splicing of the new web and the web in use to one another.

A common web alignment device for aligning a web of packaging material comprises an engagement surface for supporting the web of packaging material and a clamping device for clamping the web of packaging material on at least a clamp portion of the engagement surface once the web of packaging material is correctly aligned (oriented).

The web alignment device also comprises a continuous or discrete abutment surface arranged laterally adjacent to the engagement surface which is oriented such to provide for a reference of the web of packaging material.

In use, an operator positions the web of packaging material between the clamping device and the engagement surface, lays the web of packaging material onto the engagement surface and brings one of the lateral edges of the web of packaging material into contact with the abutment surface. Once this is done the operator actuates the web alignment device so as to clamp the web of packaging material on at least the clamp portion of the engagement surface such that the orientation of the web of packaging material is secured.

Then, the web of packaging material is transversally cut so as to define the leading portion of the web of packaging material, which can then be sealed to the trailing portion of the web of packaging material in use.

A drawback of the web alignment device resides in the risk that the operator does not correctly bring the lateral edge of the web of packaging material into contact with the abutment surface prior to clamping the web of packaging material on at least the clamp portion of the engagement surface. This then results in a web of packaging material being not correctly oriented. This may lead to the need to interrupt the operation of the packaging machine.

DISCLOSURE OF INVENTION

It is therefore an object of the present invention to provide a web alignment device to overcome, in a straightforward and low-cost manner, at least one of the aforementioned drawbacks.

It is a further object of the present invention to provide a web alignment device, which comes along with a low risk of obtaining a not correctly aligned web of packaging material, in particular prior to a splicing process.

It is an even further object of the present invention to provide an improved splicing method, which guarantees that a web in use and a new web are correctly spliced to one another.

According to the present invention, there is provided a web alignment device as claimed in claim 1.

According to the present invention, there is also provided a method of splicing a web in use and a new web according to claim 9.

Preferred embodiments are claimed in the dependent claims.

BRIEF DESCRIPTION OF THE DRAWINGS

A non-limiting embodiment of the present invention will be described by way of example with reference to the accompanying drawings, in which.

BEST MODES FOR CARRYING OUT THE INVENTION

Figure 1:
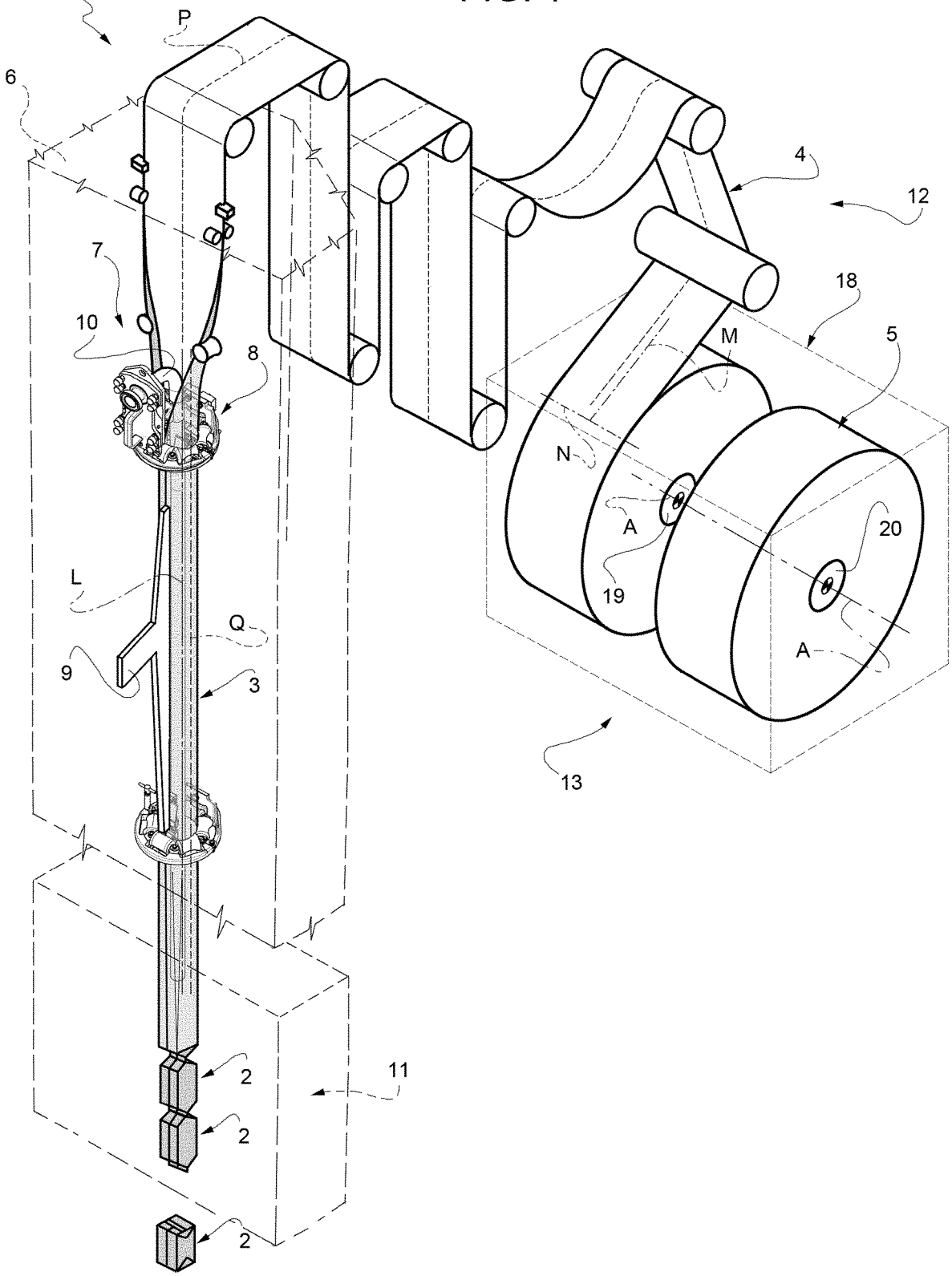
FIG. 1 is a schematic view of packaging machine for packaging a pourable product, with parts removed for clarity.

Number 1 indicates as a whole a packaging machine for producing sealed packages 2 of a pourable product, in particular a pourable food product such as pasteurized milk, fruit juice, wine, tomato sauce, etc., from a tube 3 of a first web 4 of packaging material or a second web 5 of packaging material. In particular, in use, tube 3 extends along a longitudinal axis L, in particular, axis L having a vertical orientation.

Web 4 of packaging material and web 5 of packaging material both have a multilayer structure (not shown) and are substantially identical. They comprise a respective layer of fibrous material, normally paper, covered on both sides with respective layers of heat-seal plastic material, e.g. polyethylene.

Preferably, web 4 and web 5 also comprise a respective layer of gas- and light-barrier material, e.g. aluminum foil or ethylene vinyl alcohol (EVOH) film, and at least a respective first and a second layer of heat-seal plastic material. The respective layer of gas- and light-barrier material is superimposed on the respective first layer of heat-seal plastic material, and is in turn covered with the second layer of heat-seal plastic material. The second layer of heat-seal plastic material forms the inner face of package 2 eventually contacting the filled food product.

Furthermore, web 4 and web 5 each extend along a respective longitudinal axis M and a transversal axis N.

A typical package 2 obtained by packaging machine 1 comprises a longitudinal seam portion and a pair of transversal sealing bands, in particular a transversal top sealing band and a transversal bottom sealing band.

With particular reference to FIG. 1, packaging machine 1 comprises:

- an isolation chamber 6 separating an inner environment, in particular an inner sterile environment, from an outer environment;
- a tube forming device 7 extending along a longitudinal axis, in particular having a vertical orientation, and being arranged, in particular at a forming station 8, at least partially, preferably fully, within chamber 6 and being adapted to form tube 3 from the web 4 or web 5, in particular from the, in use, advancing web 4 or web 5;
- a sealing device 9 at least partially arranged within chamber 6 and being adapted to longitudinally seal tube 3 formed by tube forming device 7 so as to form a longitudinal seam portion of tube 3;
- filling means 10 for filling tube 3 with the pourable product;
- a package forming unit 11 adapted to at least form and transversally seal tube 3, in particular the, in use, advancing tube 3, for forming packages 2; and
- conveying means 12 for advancing in a known manner one of web 4 and web 5 as the web in use along their respective longitudinal axes M and along a respective web advancement path P from a host station 13 to forming station 8, at which, in use, web 4 or web 5 is formed into tube 3 and to advance tube 3 along a tube advancement path Q towards and through package forming unit 11.

In particular, package forming unit 11 is arranged downstream of isolation chamber 6 and tube forming device 7 along path Q.

Preferably, packaging machine 1 also comprises a sterilizing unit (not shown and known as such) adapted to sterilize the, in use, advancing web 4 or web 5 at a sterilization station, in particular the sterilization station being arranged upstream of forming station 9 along path P.

Preferentially, conveying means 12 are adapted to advance tube 3 and any intermediate of tube 3 in a manner known as such along path Q, in particular from forming station 8 towards and through package forming unit 11. In particular, under intermediates of tube 3 any configuration of web 4 or web 5 is meant prior to obtaining the tube structure and after folding of web 4 or web 5 by tube forming device 7 has started. In other words, the intermediates of tube 3 are a result of the gradual folding of web 4 or web 5 so as to obtain tube 3, in particular by overlapping the lateral respective edges of web 4 or web 5 with one another.

In the following, web 4 is the web in use, however, it is clear that during operation of packaging machine 1 web 4 being the web in use and web 5 being the web in use alternate and, accordingly, the following description is not to be understood in limiting terms.

Thus, in the following, we will refer to web in use 4 and new web 5 without, however, limiting the scope of protection.

Advantageously, packaging machine 1 also comprises a magazine unit 18 (only schematically shown in FIG. 1 and known as such) arranged at host station 13 and being adapted to host at least a first reel 19 carrying in a wound-up manner a web 4 and a second reel 20 carrying in a wound-up manner a web 5.

In particular, in use, unit 18 provides for web in use 4 and new web 5.

In particular, magazine unit 18 comprises a first housing seat for rotably supporting reel 19 and a second housing seat for rotably supporting reel 20. In particular, reel 19 and reel 20 are configured to rotate around a respective central axis A, in particular having a horizontal orientation, when being placed within respectively the first housing seat or the second housing seat.

More specifically, the first housing seat and the second housing seat are spaced apart from one another and are arranged side-by-side so that, in use, wound-up web 4 and wound-up web 5 are arranged side-by-side and parallel to one another.

Preferably, magazine unit 18 also comprises a buffering device adapted to allow to buffer web 4 or web as the web in use prior to the web in use being delivered to tube forming device 7 (i.e. prior to being advanced to station 8).

Preferably, magazine unit 18 also comprises a splicing assembly (only partially shown to the extent necessary for the comprehension of the present invention) adapted to splice new web 5 and web in use 4 to one another. In particular, the splicing assembly is configured to seal, in particular to heat seal, a leading portion of new web 5 to a trailing portion of web in use 4.

Preferably, the splicing assembly is arranged upstream of the buffer device along path P. In particular, the splicing assembly is interposed between the housing seats (first housing seat and second housing seat) and the buffer device.

More specifically, the splicing assembly comprises at least a sealing group adapted to transversally seal, in particular to transversally heat seal, web in use 4 and new web 5 to one another.

Even more specifically, the sealing group is adapted to transversally heat seal the trailing portion of web in use 4 and the leading portion of new web 5 to one another.

Preferably, the splicing assembly also comprises a cutting device adapted to transversally cut web in use 4 so as to define (to obtain) the trailing portion of web in use 4.

Advantageously, magazine unit 18, in particular the splicing assembly, further comprises at least one web alignment device 21 for aligning (orienting) new web 5 according to a predefined orientation, in particular prior to splicing new web 5 and web in use 4 to one another.

More specifically, web alignment device 21 is configured to define the correct orientation of the respective axis M of new web 5.

Even more specifically, web alignment device 21 is configured to align (orient) new web 5 such that once, in use, new web 5 has become the web in use, it advances with the correct orientation along path P. Otherwise, the forming of packages 2 will be erroneous and the production process must be interrupted.

Preferably, web alignment device 21 is configured to align the new web 5 with respect to web in use 4 so that the splicing of new web 5 and web in use 4 occurs, in use, in the correct manner.

However, it must be understood that web alignment device 21 is also configured to allow for the alignment of web 4 or web 5 prior to operation of packaging machine 1 in the case no web is present within packaging machine 1.

Preferably, magazine unit 18 comprises two web alignment devices 21 (only one shown in FIGS. 2 to 6), one configured to allow for alignment of web 4 (when web 5 is the web in use and web 4 is the new web) and the other configured to allow for alignment of web 5 (when web 4 is the web in use and web 5 is the new web). In particular, the two web alignment devices 21 are arranged spaced apparat and side-by-side to one another.

Even more particular, one web alignment device 21 is associated to reel 19 and the other one is associated to reel 20.

In more detail, the web alignment device(s) 21 is(are) arranged upstream of the buffer device along path P.

In even more detail, the web alignment device(s) 21 is (are) interposed between the buffer device and the housing seats (respectively the first housing seat and the second housing seat).

Preferably, magazine unit 18 comprises a support structure (not shown) carrying web alignment device(s) 21, in particular the splicing assembly.

Even more preferably, the support structure also carries the first housing seat and the second housing seat, in particular such that the central axes A of reel 19 and of reel 20 have a horizontal orientation.

With particular reference to FIGS. 2 to 6, each web alignment device 21 comprises:

an engagement surface 22 for supporting new web 5;

a clamp assembly 23 for clamping new web 5 on at least a clamp portion (not shown) of engagement surface 22; and an alignment control assembly 24 adapted to determine and/or detect a correct alignment of new web 5.

Preferentially, each web alignment device 21 also comprises a cutting device 25 adapted to transversally cut new web 5, in particular after alignment of new web 5, for defining the leading portion of new web 5 to be sealed to the trailing portion of web in use 4.

Preferably, each web alignment device 21 has an extension along a first axis B, in particular having a horizontal orientation, and a second axis C being transversal to axis B, in particular having a substantially vertical orientation. In other words, each axis B is parallel to central axes A of reel 19 and reel 20, with reel 19 and reel 20 being placed within respectively the first housing seat and the second housing seat. In particular, in use, the respective axis C and the respective axis M with new web 5 being correctly aligned (oriented) are parallel to one another.

In more detail, each engagement surface 22 comprises a respective main surface 26, in particular carrying (comprising) the clamp portion, and being configured to support a main portion 27 of new web 5 and an auxiliary surface 28 protruding transversally away from (being angled with respect to) main surface 26 and being configured to support an auxiliary portion 29 of new web 5 protruding transversally away from main portion 27.

In even more detail, auxiliary surface 28 is arranged at an angle of substantially 90° with respect to main surface 26.

Auxiliary surface 28 is configured to support auxiliary portion 29 such to define the longitudinal position of new web 5; i.e. auxiliary surface 28 is configured such that, in use, new web 5 is moveable into a transversal direction without moving new web 5 into a longitudinal direction.

In particular, auxiliary portion 29 is obtained, in use, by transversally folding new web 5 obtaining a transversal folding line 30 parallel to axis N in the proximity of a front edge 31 of new web 5.

In further detail, each engagement surface 22, in particular main surface 26, comprises a plate-like section 36 having a substantially flat surface profile and a roller 37 having an outer lateral surface arranged peripherally adjacent to plate-like section 36 and being rotatable around a respective central axis.

In particular, plate-like section 36 and roller 37 substantially define the extensions of web alignment device 21 along axis B and axis C.

Preferably, auxiliary surface 28 protrudes transversally away from plate-like section 36.

Preferentially, plate-like section 36 is provided with (comprises) the clamp portion of engagement surface 22.

Preferentially, the clamp portion of engagement surface 22 has a substantially rectangular shape and has a substantially flat surface profile.

Figure 2:
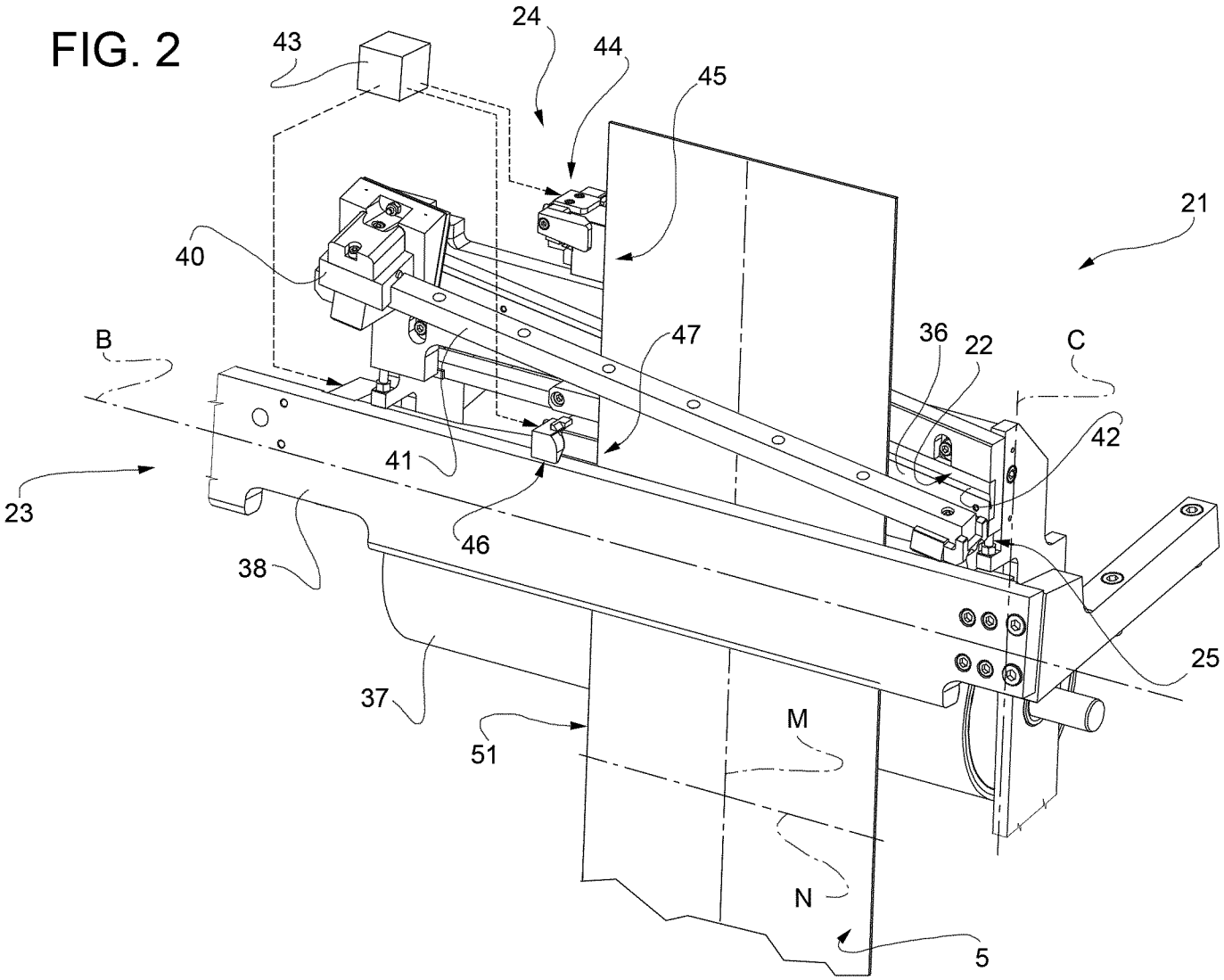
FIGS. 2 to 4 show a web alignment device according to the present invention during different moments of the alignment of a web, with parts removed for clarity.
Figure 3:
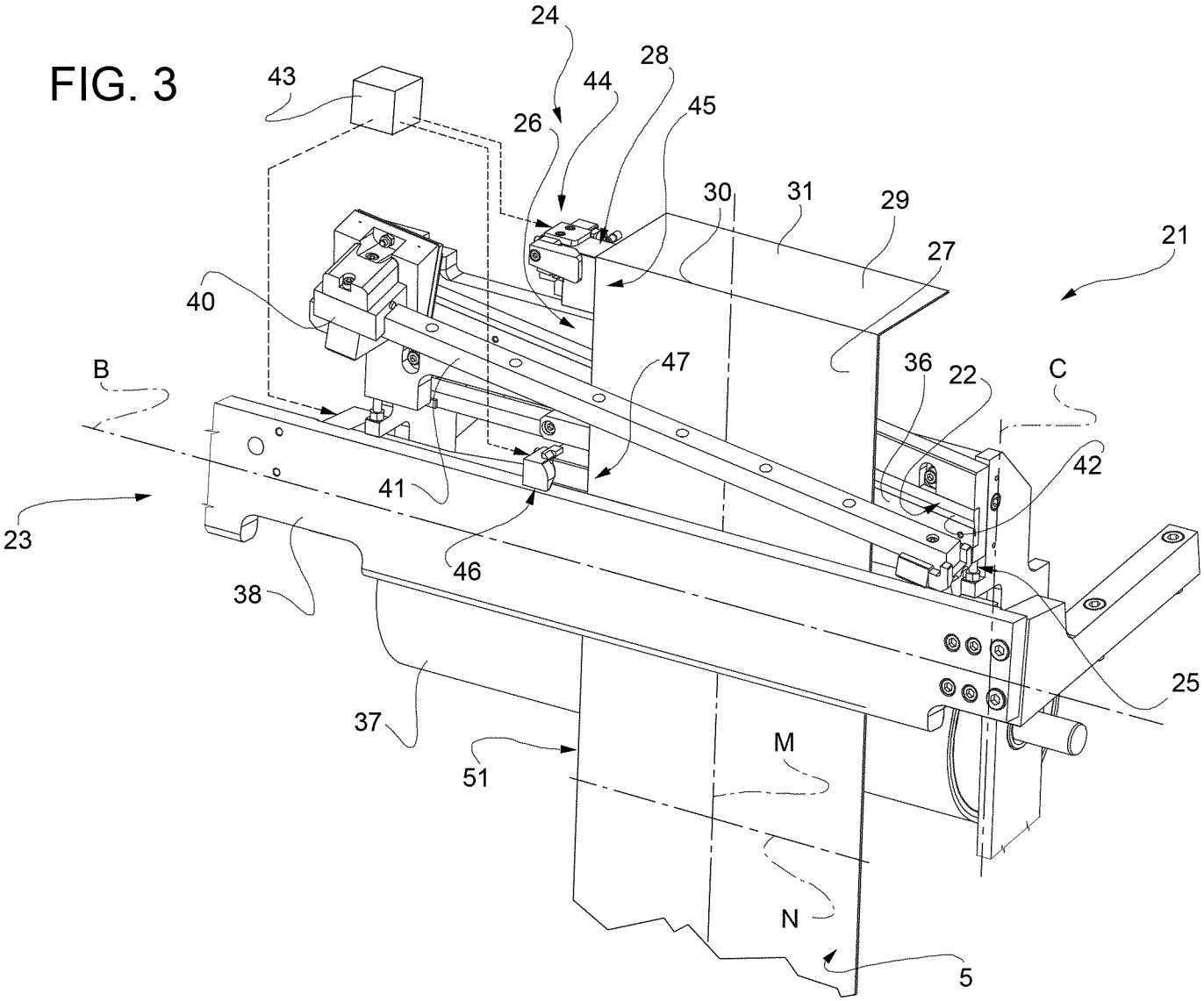
Figure 4:
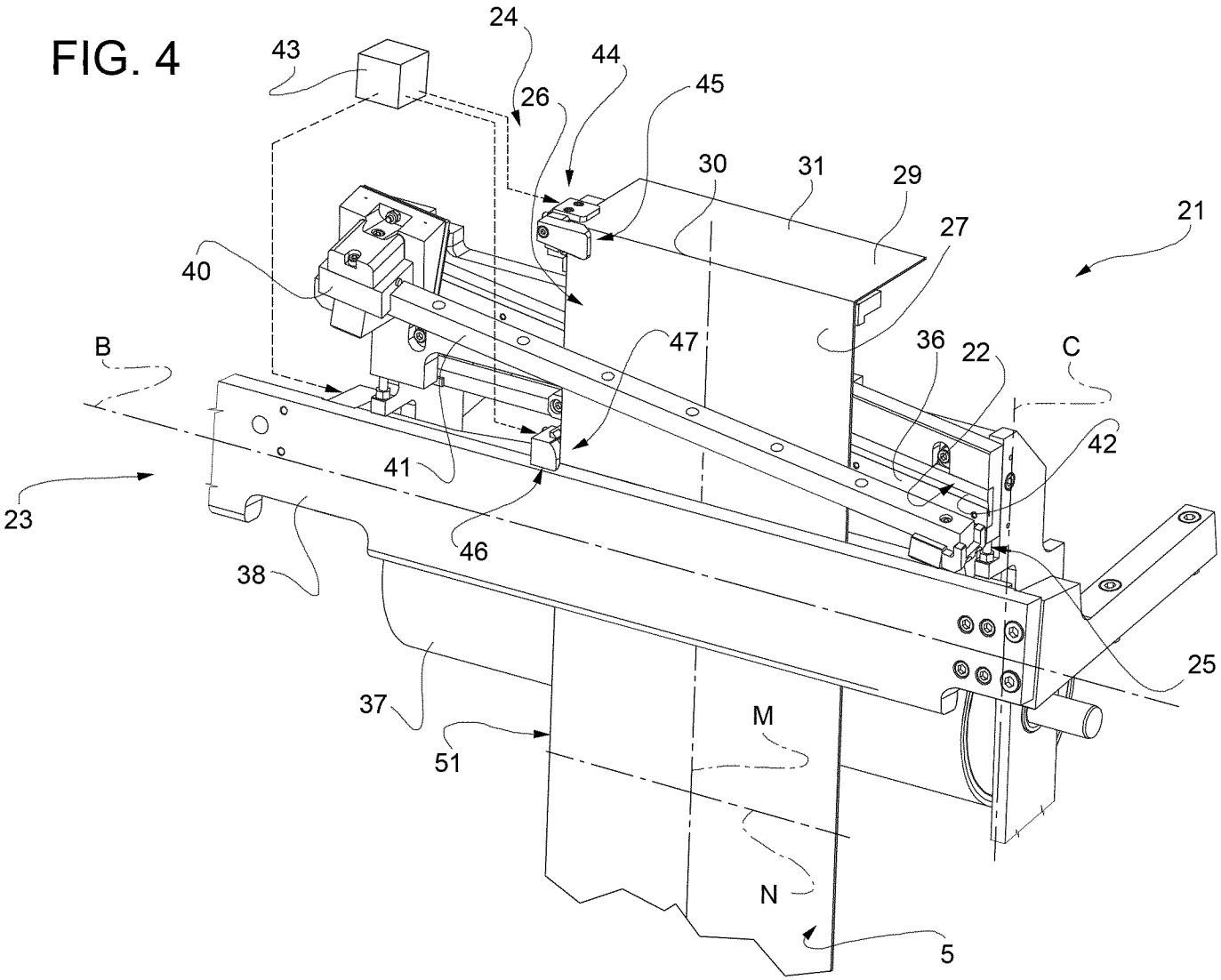

With particular reference to FIGS. 2 to 4, each clamp assembly 23 is controllable (moveable) between an open configuration in which new web 5 is, in use, moveable on at least the clamp portion of engagement surface 22, in particular on engagement surface 22, and a closed configuration in which new web 5 is, in use, clamped on (secured on) at least the clamp portion of engagement surface 22, in particular for preventing movement of new web 5.

More specifically, each clamp assembly 23 comprises a clamp board 38 facing the engagement surface 22, in particular the plate-like section 36, even more particular the clamp portion of engagement surface 22, and an actuation device (not shown) for actuating a relative movement between the clamp board 38 and at least the clamp portion of engagement surface 22 so as to move the clamp board 38 and at least the clamp portion of engagement surface 22 towards each other and away from each other.

In particular, with clamp assembly 23 being in the clamp configuration new web 5 is clamped between clamp board 38 and at least the clamp portion of engagement surface 22; and with clamp assembly 23 being in the open configuration new web 5 is moveably interposed between clamp board 38 and at least the clamp portion of engagement surface 22, in particular engagement surface 22.

In more detail, the respective actuation device is configured to define:

- the open configuration of the respective clamping assembly 23 with the distance between the respective clamp board 38 and the respective clamp portion of the respective engagement surface 22 being such that new web 5 is free to move between the respective clamp board 38 and the respective clamp portion of the respective engagement surface 22; and
- the closed configuration of the respective clamping assembly 23 with the distance between the respective clamp board 38 and the respective clamp portion of the respective engagement surface 22 being such that new web 5 is non-moveably clamped between the respective clamp board 38 and the respective clamp portion of the respective engagement surface 22.

Even more specifically, each actuation device is configured to move the respective clamp portion of the engagement surface 22 towards or away from the respective clamp board 38.

In an alternative embodiment not shown, each actuation device could be configured to move the respective clamp board 38 towards or away from the respective clamp portion of the respective engagement surface 22.

In an even further embodiment not shown, each actuation device could be configured to move both the respective clamp board 38 and the respective clamp portion of the respective engagement surface 22 towards or away from one another.

In further detail, in the specific example embodiment disclosed, each actuation device is configured to place the respective clamp portion of the respective engagement surface 22 into at least a clamp position in which the new web 5 is clamped between the respective clamp board 38 and the respective clamp portion of the respective engagement surface 22; and a rest position in which the respective clamp board 38 and the respective clamp portion of the respective engagement surface 22 are distanced from one another in such a manner that new web 5 is moveable over the respective engagement surface 22.

With particular reference to FIGS. 2 to 4, each cutting device 25 is supported by the respective engagement surface 22.

In more detail, each cutting device 25 comprises a blade (not shown) for cutting new web 5, a blade holder 40 for carrying the blade and a support bar 41 moveably carrying the respective blade holder 40. In particular, the respective engagement surface 22 comprises a groove 42 for receiving the respective blade.

Advantageously and with particular reference to FIGS. 2 to 6, each alignment control assembly 24 comprises:

- at least a control unit 43 for generating at least a trigger signal if new web 5 is correctly aligned;
- at least a first sensor device 44 connected to control unit 43 and being configured to detect and/or determine at least a respective desired position of a first section 45 of new web 5 and to send at least a first signal to control unit 43 if first section 45 is positioned in the desired position; and
- at least a second sensor device 46 connected to control unit 43 and being configured to detect and/or determine at least a respective desired position of a second section 47 of new web 5 distinct from first section 45 and to send a second signal to control unit 43 if second section 47 is positioned in the respective desired position.

Advantageously, each control unit 43 is configured to generate the trigger signal indicating the correct alignment of new web 5 if both the respective sensor device 44 and the respective sensor device 46 send, in use, simultaneously (at the same time, contemporaneously) respectively the first signal and the second signal to the respective control unit 43.

Preferably, each control unit 43 is configured such that once the trigger signal has, in use, been generated and prior to the completion of clamping the new web 5 on at least the clamp portion of the respective engagement surface 22, new web 5 becomes erroneously displaced so that new web 5 is not correctly aligned (oriented), the generation of the trigger signal is interrupted.

In an embodiment not shown, each control unit 42 is configured such that in the case of the generation of the trigger signal, a message signal is generated, e.g. in the form of a light signal, on a message display or the like, indicating the correct alignment of new web 5. Then, in use, an operator can move the respective clamp assembly 23 to the respective closed configuration so as to secure new web 5 and to retain the orientation of new web 5. In the case the generation of the trigger signal is interrupted prior to clamping new web 5, also the message signal is interrupted.

In the preferred embodiment disclosed, each control unit 42 is also configured to control the respective clamp assembly 23 into the closed configuration when generating the trigger signal. Such a preferred embodiment has the advantage that the operator handling the new web 5 during the alignment process does not accidently move new web 5 (thus, changing the orientation) while moving the respective clamp assembly 23 into the respective closed configuration.

Preferentially, in the case the generation of the trigger signal is interrupted also the clamping of new web 5 is interrupted.

More specifically, each control unit 43 is connected, in particular electronically connected to, the respective actuation device and is configured to send a respective control signal to the respective actuation device.

In more detail, each sensor device 44 and the respective sensor device 46 are spaced apart from one another, in particular along the respective axis C.

Preferably, each sensor device 44 and the respective sensor device 46 are adapted to interact with a lateral edge, in particular a lateral longitudinal edge 51 of new web 5. In particular, the respective section 45 and the respective section 47 are associated to the respective edge 51. Even more particular, the respective section 45 and the respective section 47 are defined as the zones of the respective edge 51 respectively interacting with the respective sensor device 44 and the respective sensor device 45.

Figure 5:
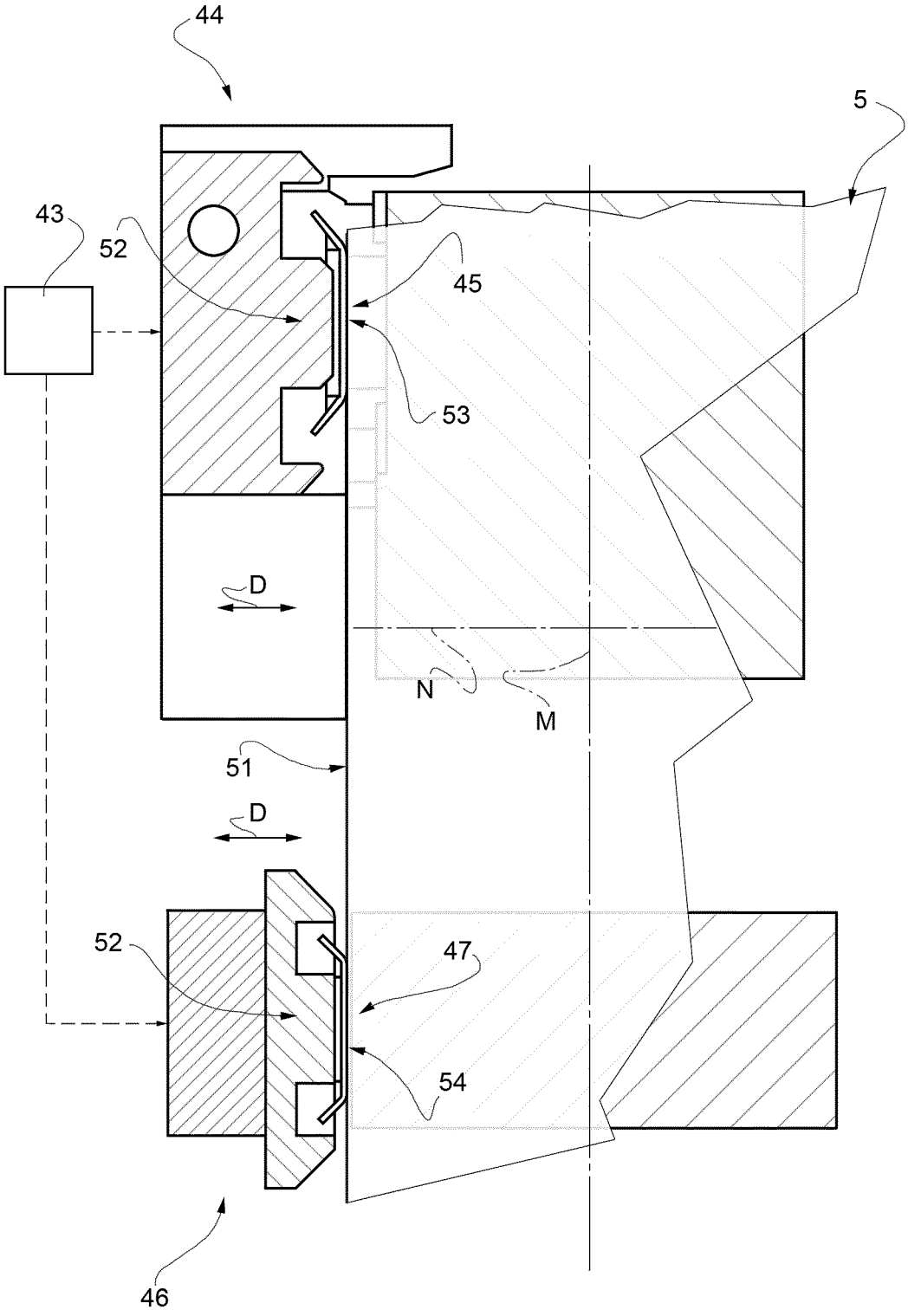
FIGS. 5 and 6 show a detail of the web alignment device in two different configurations, with parts removed for clarity.
Figure 6:
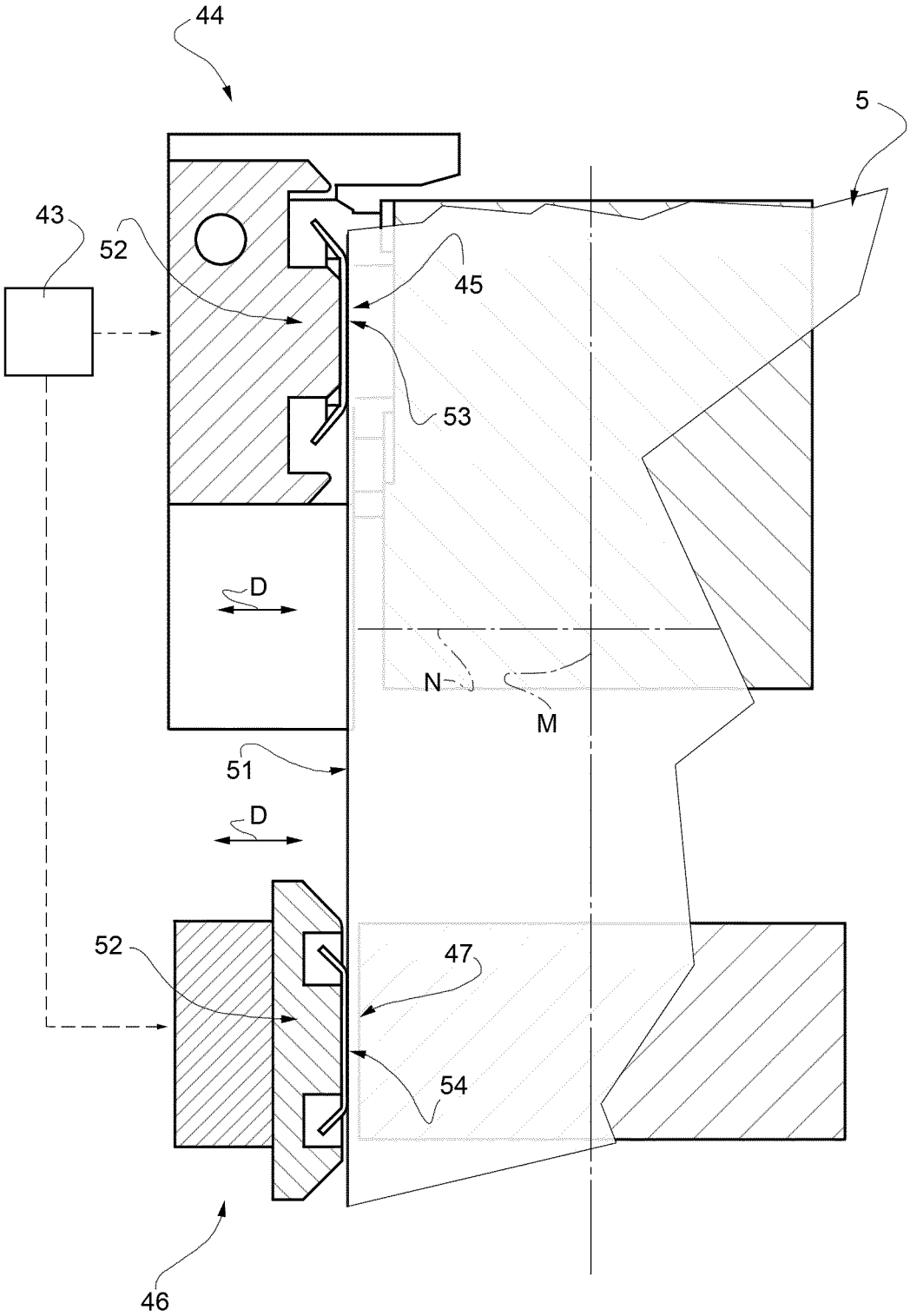

With particular reference to FIGS. 5 and 6, sensor device 44 and sensor device 46 each comprises a respective switch element 52 being controllable between at least a respective passive configuration and a respective active configuration in which the respective switch element 52 generates respectively the respective first signal and the respective second signal.

In even further detail, each switch element 52 is configured to be controllable between the respective passive configuration and the respective active configuration through interaction with the respective edge 51, in particular with the respective section 45 or the respective section 47.

Preferably, each switch element 52 is configured such that it is controlled into the respective active configuration with the respective section 45 or the respective section 47 being in the desired position.

Accordingly, each sensor device 44 and the respective sensor device 46 are configured to generate respectively the first signal and the second signal if the respective switch element 52 is in the respective active configuration.

Preferably, web alignment device 21, in particular alignment control assembly 24, further comprises a first abutment surface 53 and a second abutment surface 54 spaced apart, in particular along axis C, from one another and each one being adapted to interact with (to be contacted by) edge 51 of new web 5, in particular with respectively the respective section 45 and the respective section 47 for defining the desired orientation of the web.

Preferentially, each abutment surface 53 and each abutment surface 54 are moveable along a respective direction D, in particular parallel to axis B, between at least an initial position (see FIG. 5) and an end position (see FIG. 6).

In particular, both the respective abutment surfaces 53 and the respective abutment surface 54 define a rectilinear line when each one is arranged in the respective end position, in particular the rectilinear line being parallel to axis C. The rectilinear line is configured such to define the orientation of new web 5.

More specifically, each abutment surface 53 and the respective abutment surface 54 are configured to be controlled between the initial configuration and the end configuration upon interaction with (upon being contacted by) the respective edge 51. In particular, in use, with the respective edge 51 of new web 5 interacting with (being in contact with) the respective abutment surface 53 and the respective abutment surface 54 new web 5 is correctly aligned if both the respective abutment surface 53 and the respective abutment surface 54 are in the respective end position.

Preferentially, web alignment device 21, in particular alignment control assembly 24, further comprises biasing means for biasing the abutment surface and the abutment surface 54 into the respective initial positions.

Preferentially, each sensor device 44 comprises the respective abutment surface 53 and each sensor device 46 comprises the respective abutment surface 54.

In more detail, each abutment surface 53 and the respective abutment surface 54 are coupled to the respective switch element 52 in such a manner that the respective switch element 52 is controlled between the respective passive configuration and the respective active configuration upon controlling the respective abutment surface 53 or the respective abutment surface between the respective initial position and the respective end position.

In even more detail, each switch element 52 is in the respective passive configuration with the respective abutment surface 53 or the respective abutment surface 54 being in the respective initial position; and each switch element 52 is in the active configuration with the respective abutment surface 53 or the respective abutment surface 54 being in the respective end position.

In even further detail, each switch element 52 is configured such to bias the respective abutment surface or the respective abutment surface 54 into the initial position. In other words, switch elements 52 comprise the biasing means.

In use, packaging machine 1 packages the pourable product into packages 2 obtained from tube 3.

In more detail, during operation of packaging machine 1 one of web 4 or web 5 is advanced as the web in use from the respective reel 19 or reel 20 along path P, is formed by tube forming device 7 into tube 3 and tube 3 is longitudinally sealed by sealing device 9, while tube 3 advances along path Q. Furthermore, filling means 10 fill tube 3 with the pourable product and package forming unit 11 forms, transversally seals and transversally cuts packages 2 from tube 3 advancing along path Q.

Furthermore, during operation of packaging machine 1, prior to exhaustion of web 4 or web 5 advanced as the web in use, the web in use and the new web are subjected to a splicing process.

With particular reference to FIGS. 2 to 6, the splicing process comprises at least:

- an advancement phase during which one of a web 4 and web 5 is advanced along path P as the web in use, in the specific case web 4 is advanced as the web in use 4;
- an alignment phase during which the other one of web 4 and web 5 is aligned as the new web according to a defined orientation, in the specific case shown web 5 is aligned as the new web 5; and
- a splicing phase during which the trailing portion of web in use 4 and the leading portion of new web 5 are sealed, in particular heat sealed, to one another.

In more detail, during the advancement phase web in use 4 is unwound from reel 19 and is advanced towards tube forming device 7, in particular while advancing through the buffer device.

In more detail, during the splicing phase the trailing portion of web in use 4 and the leading portion of new web 5 are superimposed and are transversally sealed to one another by the sealing group.

In further detail, during the splicing phase web in use 4 is advanced towards tube forming device 7 from the buffer device and advancement of web in use 4 from reel 19 to the buffer device is interrupted. Preferably, web in use 4 is transversally cut, in particular upstream of the buffer device along path P, so as to define the trailing portion of web in use 4.

In more detail, the alignment phase comprises:

- an engagement sub-phase during which new web 5 is engaged onto engagement surface 22;
- a displacement sub-phase, in particular executed after the engagement sub-phase, during which new web 5 is displaced, in particular transversally displaced;
- at least a first detection sub-phase during which sensor device 44 detects and/or determines whether the respective first section 45 is in its respective desired position and during which sensor device 44 sends at least the first signal to control unit 43 if first section 45 is positioned in the desired position;
- at least a second detection sub-phase during which sensor device 46 detects and/or determines whether the second section 47 is in its respective desired position and during which sensor device 46 sends at least the second signal to control unit 43 if second section 47 is positioned in the desired position;
- an accumulative control sub-phase during which control unit 43 generates a trigger signal indicating the correct alignment (the correct orientation) of new web 5 if sensor device 44 and sensor device 46 send contemporaneously (simultaneously, at the same time) respectively the first signal and the second signal to control unit 43; and
- a clamping sub-phase, executed after the displacement sub-phase, in particular if during the accumulative control sub-phase control unit 43 generates the trigger signal, during which new web 5 is clamped onto the clamp portion of engagement surface 22.

Preferentially, the alignment phase also comprises a cutting sub-phase, in particular executed after the clamping sub-phase, during which new web 5 is cut, in particular transversally cut, so as to define the leading portion of new web 5. In particular, during the cutting sub-phase blade holder 40 is moved along support bar 41 so that the blade cuts new web 5. In particular, new web 5 and web in use 4 are sealed to one another after the cutting sub-phase.

In more detail, during the engagement sub-phase (see FIG. 2) new web 5 is put in contact with engagement surface 22 and is laterally spaced apart from sensor device 44 and sensor device 46.

In particular, during the engagement sub-phase new web 5 is guided such to be interposed between engagement surface 22, in particular plate-like section 36, and clamp board 38 with clamp assembly 23 being in the open configuration. New web 5 is also guided such that it is interposed between engagement surface 22, in particular plate-like section 36, and support bar 41.

Preferably, during the engagement sub-phase a folding step is executed during which new web 5 is transversally folded so as to obtain auxiliary portion 29 and main portion 27. Then, auxiliary portion 29 is engaged onto auxiliary surface 28 and main portion 27 is engaged onto main surface 26 (see FIG. 3).

With particular reference to FIGS. 4 to 6, during the displacement sub-phase new web 5 is transversally displaced towards sensor device 44 and sensor device 46, in particular edge 51 is brought into abutment with abutment surface 53 and abutment surface 54, even more particular section 45 is brought into contact with abutment surface 53 and section 47 is brought into contact with abutment surface 54.

Preferentially, during the displacement sub-phase new web 5 is transversally displaced such that abutment surface 53 and abutment surface 54 are displaced along the respective direction D from the respective initial position to the respective end position. In particular, with abutment surface 53 and abutment surface 54 being in the respective end position and section 45 being in abutment with abutment surface 53 and section 47 being in abutment with abutment surface 54 section 45 and section 47 are in the respective desired positions.

In more detail, during the first detection sub-phase sensor device 44 sends the first signal if the respective switch element 52 is in the respective active position, in particular with the respective abutment surface 53 being in the respective end position.

More specifically, during the second detection sub-phase sensor device 46 sends the second signal if the respective switch element 52 is in the respective active position, in particular with the respective abutment surface 54 being in the respective end position.

In more detail, during the clamping sub-phase clamp assembly 23 is controlled from its respective open configuration into its respective closed configuration.

Preferably, clamp assembly 23 is automatically controlled by control unit 43 from the open configuration to the closed configuration when control unit 43 generates the trigger signal.

In more detail, during the clamping sub-phase a relative movement between clamp board 38 and at least the clamp portion of engagement surface 22 is actuated by activation of the actuation device.

In even more detail, the clamp portion of engagement surface 22 is moved from the respective rest position to the respective clamp position. In particular, control unit 43 activates the actuation device when generating the trigger signal so that the actuation device moves the clamp portion of engagement surface 22 to the clamp position.

The advantages of web alignment device 21 according to the present invention will be clear from the foregoing description.

In particular, web alignment device 21 reduces the risk of a misalignment of the new web, in particular prior to the splicing of the new web to the web in use. Even more particular, by providing the respective sensor device 44 and the respective sensor device 46 it is possible to ensure that a trigger signal is only generated if the respective section 45 and the respective section 47 are arranged in the desired position, which are characteristic of the correct alignment (orientation) of the new web.

A further advantage resides in the fact that the respective control unit 43 automatically activates the respective clamp assembly 23 so that the new web becomes automatically fixed on at least the clamp portion of the respective engagement surface 22. This ensures that an operator cannot erroneously clamp the new web. In addition, it is prevented that the new web is clamped on at least the clamp portion of the respective engagement surface 22 even though the orientation was modified once a trigger signal was generated.

Clearly, changes may be made to packaging machine 1, in particular to web alignment device 21 as described herein without, however, departing from the scope of protection as defined in the accompanying claims.

In an alternative embodiment not shown, sensor device 44 and sensor device 46 comprise optical detection means and are adapted to detect, new web 5, in particular respective markers arranged on new web 5.

The invention claimed is:

1. Web alignment device for aligning an integrated web within a packaging machine comprising an engagement surface for supporting the integrated web and a clamp assembly for clamping the integrated web on at least a clamp portion of the engagement surface;

the web alignment device comprising an alignment control assembly adapted to determine and/or detect a correct alignment of the integrated web;

wherein the alignment control assembly comprises:

at least a control unit for generating at least a trigger signal if the integrated web is correctly aligned;

at least a first sensor device connected to the control unit and being configured to detect and/or determine at least a desired position of a first section of the integrated web and to send at least a first signal to the control unit if the first section is positioned in the desired position; and at least a second sensor device connected to the control unit and being configured to detect and/or determine at least a desired position of a second section of the integrated web distinct from the first section and to send a second signal to the control unit if the second section is positioned in the desired position;

wherein the control unit is configured to generate the trigger signal indicating the correct alignment if the first sensor device and the second sensor device send contemporaneously, in use, respectively the first signal and the second signal to the control unit.

2. The web alignment device according to claim 1 and further comprising a first abutment surface and a second abutment surface spaced apart from one another and being adapted to interact with a lateral edge of the integrated web carrying the first section and the second section, the first abutment surface and the second abutment surface being configured to define a desired orientation of the integrated web.

3. The web alignment device according to claim 2, wherein each one of the first sensor device and the second sensor device comprises a respective switch element being controllable between at least a respective passive configuration and a respective active configuration in which the switch element generates respectively the first signal and the second signal;

wherein each one of the switch elements is configured to be controllable between the respective passive configuration and the respective active configuration through interaction with the lateral edge of the integrated web;

wherein each one of the switch elements is configured such that the respective switch element is in the respective active configuration with respectively the first section and the second section being in the respective desired position.

4. The web alignment device according to claim 3, wherein the first abutment surface is coupled to the respective switch element of the first sensor device and the second abutment surface is coupled to the respective switch element of the second sensor device;

wherein each one of the first abutment surface and the second abutment surface is moveable along a respective direction between an initial position and an end position;

wherein each one of the first abutment surface and the second abutment surface and the respective switch element are coupled to one another in such a manner that the respective switch element is in the passive configuration with respectively the first abutment surface and the second abutment surface being in the respective initial position and the respective switch element being in the active configuration with respectively the first abutment surface and the second abutment surface being in the respective end position.

5. The web alignment device according to claim 1, wherein the clamp assembly is controllable between an open configuration in which the integrated web is moveable on the engagement surface and a closed configuration in which the integrated web is clamped on at least the clamp portion of the engagement surface;

wherein the control unit is configured to move the clamp assembly to the closed configuration when generating the trigger signal.

6. The web alignment device according to claim 1, wherein the engagement surface comprises a main surface configured to support a main portion of the integrated web and an auxiliary surface being angled with respect to the main surface and being configured to support an auxiliary portion of the integrated web protruding transversally away from the main portion.

7. The web alignment device according to claim 1, wherein each one of the first sensor device and the second sensor device comprises a respective switch element being controllable between at least a respective passive configuration and a respective active configuration in which the switch element generates respectively the first signal and the second signal;

wherein each one of the switch elements is configured to be controllable between the respective passive configuration and the respective active configuration through interaction with the lateral edge of the integrated web;

wherein each one of the switch elements is configured such that the respective switch element is in the respective active configuration with respectively the first section and the second section being in the respective desired position.

8. A packaging machine for producing sealed packages of a pourable product comprising:

a magazine unit arranged at a host station and being adapted to host at least a first reel carrying in a wound-up manner a first integrated web of packaging material and a second reel carrying in a wound-up manner a second integrated web of packaging material;

an isolation chamber separating an inner environment from an outer environment;

a tube forming device at least partially arranged within the isolation chamber at a forming station and being adapted to form a tube from a web in use;

a sealing device at least partially arranged within the isolation chamber and being adapted to longitudinally seal the tube formed by the tube forming device;

filling means for filling the tube with the pourable product;

a package forming unit adapted to form and to transversally seal the tube for forming the packages; and conveying means for advancing at least one of the first integrated web of packaging material and the second integrated web of packaging material as the web in use along a web advancement path from the host station to the forming station, in which, in use, the web in use is formed into the tube and for advancing the tube along a tube advancement path to the package forming unit;

wherein the magazine unit comprises at least one web alignment device according to claim 1 for aligning at least one of the first integrated web of packaging material and the second integrated web of packaging material prior to the first integrated web of packaging material or the second integrated web of packaging material being advanced as the web in use.

9. The packaging machine according to claim 8, wherein the magazine unit comprises two of the web alignment devices, one of the web alignment devices being configured to align the first integrated web of packaging material and the other of the web alignment devices being configured to align the second integrated web of packaging material.

10. A method of splicing a web of packaging material in use and a new web of packaging material comprising:

an advancement phase during which one of a first integrated web of packaging material and a second integrated web of packaging material is advanced along a web advancement path as a web in use;

an alignment phase during which the other one of the first integrated web of packaging material and of the second integrated web of packaging material is aligned as a new web according to a defined orientation;

a splicing phase during which a trailing portion of the web in use and a leading portion of the new web are sealed to one another;

wherein the alignment phase comprises:

an engagement sub-phase during which the new web is engaged onto an engagement surface;

a displacement sub-phase during which the new web is displaced;

at least a first control sub-phase, during which a first sensor device detects and/or determines whether a first section of the new web is in a respective desired position and sends at least a first signal to a control unit if the first section is positioned in the desired position;

at least a second control sub-phase during which a second sensor device detects and/or determines whether a second section of the new web distinct from the first section is in a respective desired position and sends a second signal to the control unit if the second section is positioned in the desired position; and an accumulative control sub-phase, during which the control unit generates a trigger signal indicating the correct alignment of the new web if the first sensor device and the second sensor device send contemporaneously respectively the first signal and the second signal to the control unit.

11. The method according to claim 10, wherein the new web has a lateral edge carrying the first section and the second section;

wherein during the displacement sub-phase the new web is displaced so that the first section and the second section are brought into contact with respectively a first abutment surface and a second abutment surface.

12. The method according to claim 11, wherein during the displacement sub-phase the new web is displaced such that the first abutment surface and the second abutment surface are moved along a respective displacement direction from a respective initial position to a respective end position so as to place the first section and the second section in the desired position;

wherein the first sensor device and the second sensor device send respectively the first signal and the second signal when the first abutment surface and the second abutment surface are arranged in the respective end position.

13. The method according to claim 10, and further comprising a clamping sub-phase during which a clamp assembly clamps the new web on at least a clamp portion of the engagement surface;

wherein during the clamping sub-phase the clamp assembly is automatically moved by the control unit from an open configuration in which the new web is moveable on at least the clamp portion of the engagement surface to a closed configuration in which the new web is clamped on at least the clamp portion of the engagement surface;

wherein the control unit activates the clamping sub-phase when it generates the trigger signal.

14. The method according to claim 10, wherein during the engagement sub-phase a folding step is executed during which the new web is transversally folded so as to obtain a main portion and an auxiliary portion of the new web;

wherein the main portion is placed on a main surface of the engagement surface and the auxiliary portion is placed on an auxiliary surface of the engagement surface being angled with respect to the main surface.

15. Web alignment device for aligning a an integrated web within a packaging machine comprising an engagement surface for supporting the integrated web and a clamp assembly for clamping the integrated web on at least a clamp portion of the engagement surface, the integrated web including a lateral longitudinal edge extending along a length of the integrated web at one lateral edge of the integrated web, the web alignment device comprising:

an alignment control assembly configured to determine and/or detect a correct alignment of the integrated web, the alignment control assembly comprising:

at least a control unit for generating at least a trigger signal if the integrated web is detected or determined to be correctly aligned;

at least a first sensor device connected to the control unit and configured to detect and/or determine at least a desired position of a first section of the lateral longitudinal edge of the integrated web and to send at least a first signal to the control unit if the at least first sensor device detects and/or determines that the first section of the lateral longitudinal edge of the integrated web is positioned in the desired position; and at least a second sensor device connected to the control unit and configured to detect and/or determine at least a desired position of a second section of the lateral longitudinal edge of the integrated web and to send at least a second signal to the control unit if the at least first second device detects and/or determines that the second section of the lateral longitudinal edge of the integrated web is positioned in the desired position, the first section of the lateral longitudinal edge of the integrated web being spaced from the second section of the lateral longitudinal edge of the integrated web;

the at least first sensor device and the at least second sensor device being spaced apart from one another at positions on a common side of the integrated web, in use;

the first sensor device and the second sensor device sending simultaneously, in use, respectively the first signal and the second signal to the control unit when the integrated web is correctly aligned; and the control unit being configured to generate the trigger signal indicating the correct alignment when the first sensor device and the second sensor device send simultaneously, in use, respectively the first signal and the second signal to the control unit.

16. The web alignment device according to claim 15, wherein the at least first sensor device comprises a first abutment surface configured to contact the lateral longitudinal edge of the integrated web during use, the at least second sensor device comprising a second abutment surface configured to contact the lateral longitudinal edge of the integrated web during use, the first abutment surface and the second abutment surface being located on a common line.

17. The web alignment device according to claim 15, wherein the at least first sensor device comprises a first abutment surface configured to contact the lateral longitudinal edge of the integrated web during use, the at least second sensor device comprising a second abutment surface configured to contact the lateral longitudinal edge of the integrated web during use, the first abutment surface and the second abutment surface being movable in a common direction.

18. The web alignment device according to claim 15, wherein the at least first sensor device comprises a first abutment surface configured to contact the lateral longitudinal edge of the integrated web during use, the at least second sensor device comprising a second abutment surface configured to contact the lateral longitudinal edge of the integrated web during use, the first abutment surface and the second abutment surface being spaced apart from one another in a first direction, the first abutment surface and the second abutment surface being movable in a second direction perpendicular to the first direction.

19. The web alignment device according to claim 15, wherein each one of the first sensor device and the second sensor device comprises a respective switch element that is controllable between at least a respective passive configuration and a respective active configuration in which the switch element generates respectively the first signal and the second signal;

each one of the switch elements being configured to be controllable between the respective passive configuration and the respective active configuration through interaction with the longitudinal lateral edge of the integrated web;

each one of the switch elements being configured such that the respective switch element is in the respective active configuration with respectively the first section and the second section being in the respective desired position.

* * * * *